US009296553B1

(12) United States Patent
Glass

(10) Patent No.: US 9,296,553 B1
(45) Date of Patent: Mar. 29, 2016

(54) BI-FOLD GIFT CARD HOLDER

(75) Inventor: Brett R. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 12/791,864

(22) Filed: Jun. 1, 2010

Related U.S. Application Data

(60) Provisional application No. 61/182,741, filed on May 31, 2009, provisional application No. 61/305,943, filed on Feb. 18, 2010, provisional application No. 61/228,248, filed on Jul. 24, 2009.

(51) Int. Cl.
*B65D 69/00* (2006.01)
*B65D 71/00* (2006.01)
*B65D 85/57* (2006.01)

(52) U.S. Cl.
CPC ..... *B65D 85/546* (2013.01)

(58) Field of Classification Search
CPC .... B65D 85/546; B65D 85/544; B42F 5/005; G11B 23/0236
USPC ..... 206/349, 312, 232, 39, 459.1; 229/92.8, 229/67.3, 67.4; 40/124.01, 124.03, 124.06, 40/124.09, 124.12, 705, 733; 705/41; 281/50
See application file for complete search history.

(56) References Cited

U.S. PATENT DOCUMENTS 3,594,937 A 7/1971 Luchsinger
4,286,399 A 9/1981 Funahashi et al.
4,363,081 A 12/1982 Wilbur
4,433,780 A * 2/1984 Ellis ..... 206/232
4,941,172 A 7/1990 Winebaum et al.
5,245,171 A 9/1993 Fox et al.
5,275,285 A 1/1994 Clegg
5,373,283 A 12/1994 Maharshak
5,387,108 A * 2/1995 Crowell ..... 434/319
6,104,306 A 8/2000 Hogue et al.
6,158,588 A 12/2000 Conti
6,443,301 B2 * 9/2002 Garnier ..... 206/312
6,675,511 B2 * 1/2004 Pines ..... 40/124.03
6,698,116 B2 * 3/2004 Waldron ..... 40/124.11
6,732,459 B1 * 5/2004 Clark ..... 40/124.06
6,938,759 B2 * 9/2005 Golden et al. ..... 206/308.3
7,219,829 B2 * 5/2007 Treat ..... 229/92.8
7,240,442 B2 * 7/2007 Clegg ..... 40/124.03
7,252,225 B2 8/2007 Schultz et al.
7,275,683 B2 * 10/2007 Lazarowicz et al. ..... 235/375
7,857,196 B1 * 12/2010 Gorman ..... 229/82
2005/0044756 A1 3/2005 Abrahams
2007/0094901 A1 5/2007 Kibbe et al.
2007/0200000 A1 8/2007 Sanders
2008/0116088 A1 5/2008 Roberts
2008/0116089 A1 5/2008 Roberts
2009/0006219 A1 * 1/2009 Blake et al. ..... 705/26
2009/0038968 A1 2/2009 Smith (Continued)

FOREIGN PATENT DOCUMENTS

WO WO2006022950 A2 3/2006

*Primary Examiner* — Jacob K Ackun
*Assistant Examiner* — Rafael Ortiz
(74) *Attorney, Agent, or Firm* — Polsinelli PC

(57) ABSTRACT

A bi-fold holder that wraps around a gift card carrier panel or gift card packet, while occupying substantially the same display space as the panel or packet would occupy on a display stand, thereby enhancing the value of the gift while allowing the same number of individual units to be displayed across a display stand.

14 Claims, 7 Drawing Sheets

(56) References Cited

U.S. PATENT DOCUMENTS

2009/0126239 A1 5/2009 Clegg
2009/0140042 A1 6/2009 Clegg
2011/0137793 A1* 6/2011 Liggett ..... 705/41

* cited by examiner

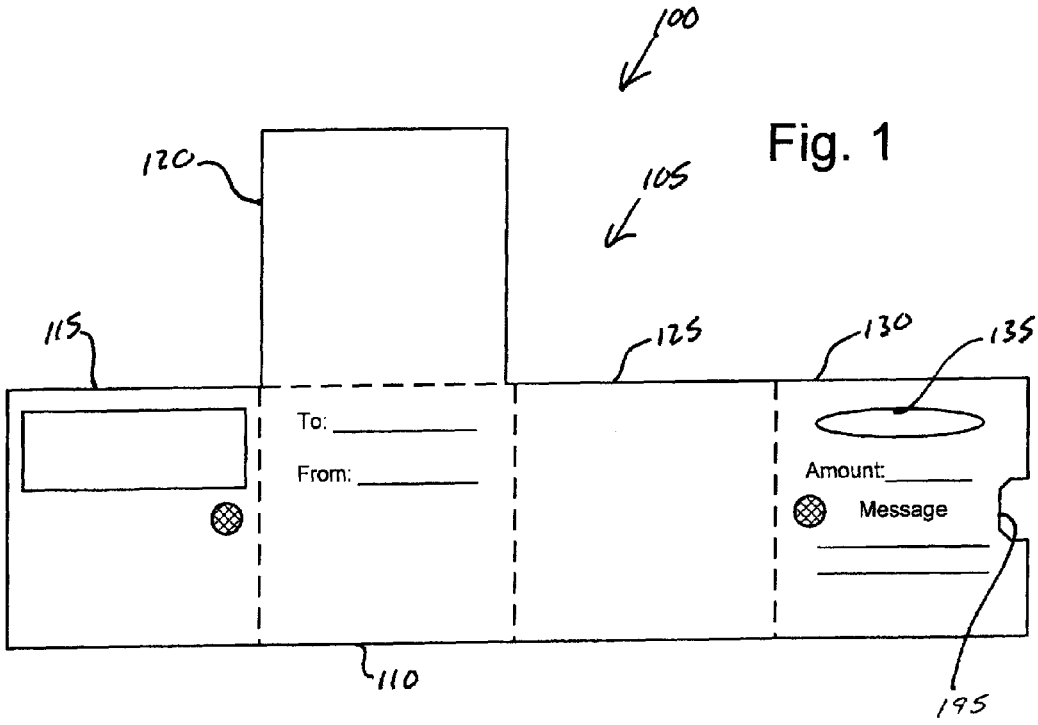
Fig. 1
Fig. 2
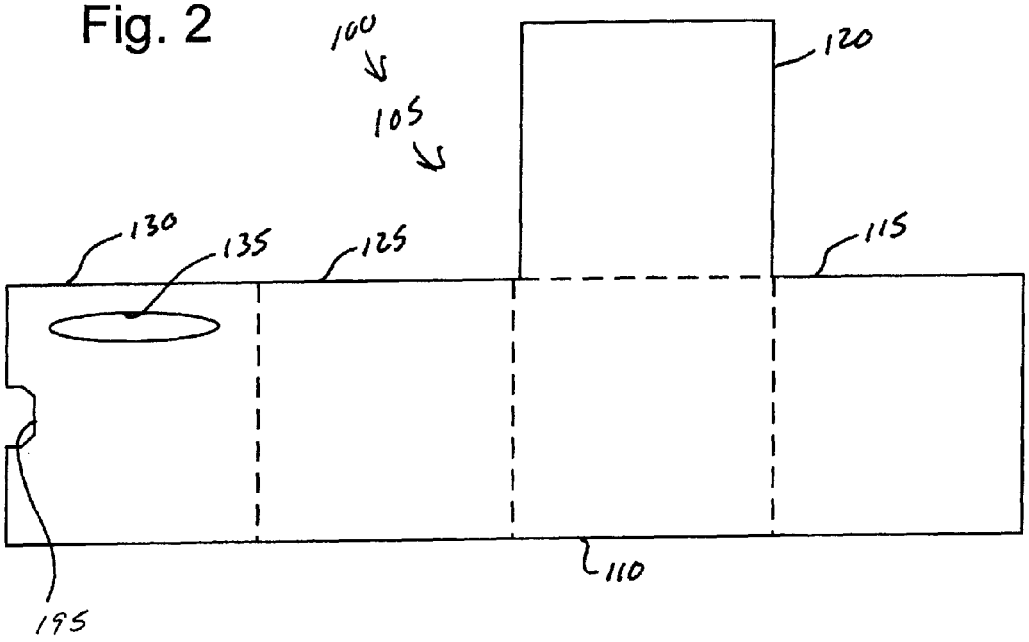

Fig. 6
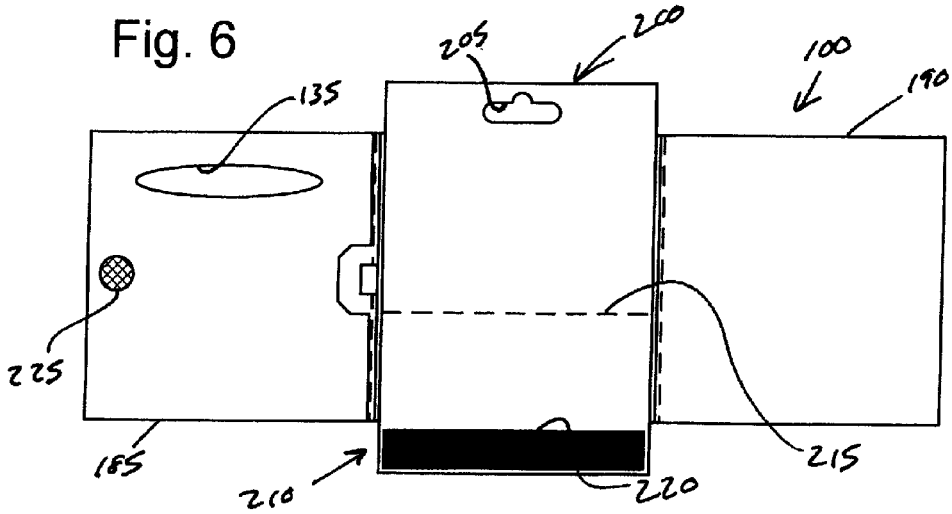
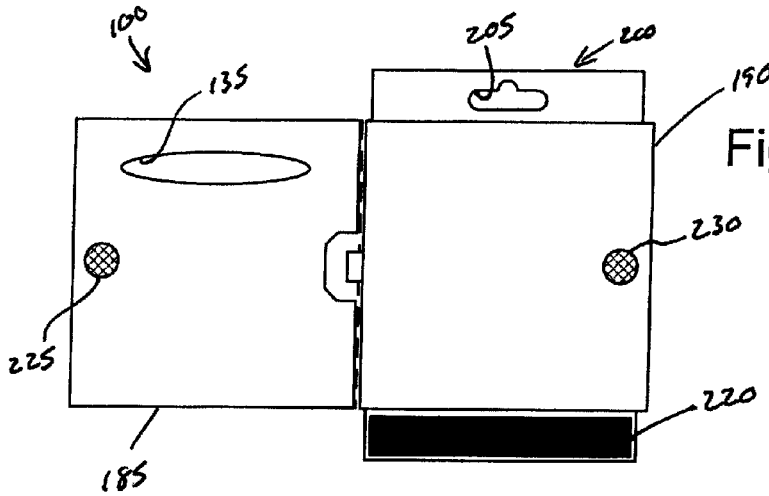
Fig. 7
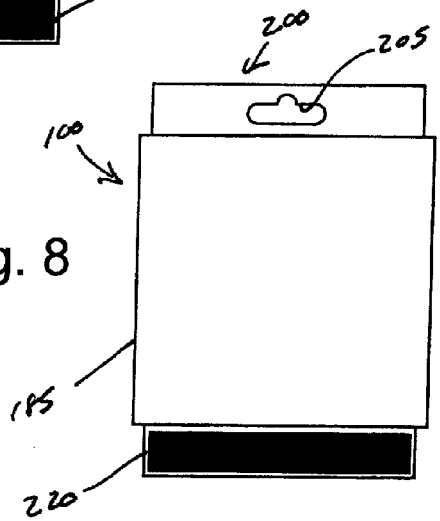
Fig. 8

BI-FOLD GIFT CARD HOLDER

CROSS REFERENCE TO RELATED APPLICATIONS

This application claims the benefit of the prior filed, provisional applications, Ser. Nos. 61/182,741, filed May 31, 2009, 61/228,248, filed Jul. 24, 2009, and 61/305,943, filed Feb. 18, 2010, each incorporated by reference herein.

BACKGROUND OF THE INVENTION

This invention relates generally to gift cards and more particularly to a device for holding and displaying gift cards while providing indicia and/or audio recordings selected or provided by the purchaser to personalize the gift.

Transaction cards, stored value cards, or gift cards as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores. The cards are typically attached to a gift card carrier panel or sheet via removable adhesive or plastic wrap and the carrier panel is hung upon a display stand peg. Alternatively, gift cards may be sold in a sealed packet. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards.

In addition to the above considerations, and to comply with certain industry standards, gift cards must fit within a set allocated space in pre-existing displays. Typically, a gift card carrier panel or packet must not exceed 5.25" tall and 4" wide. These dimensions are an industry standard and are typically non-negotiable. In addition, for gift cards that use barcodes the carrier panel must have a 0.75" tall×3.125" wide die cut window to provide access to the C128 barcode on the gift card when affixed to the carrier. In order to properly hang each gift card, carrier panels or associated hang tags are also typically required to include a J-hook hole (sombrero cut) with the dimensions of 1.875" wide by 0.5" high, and to be placed 0.1875" from the top of the carrier panel or hang tag. Presently, the above requirements pertain to approximately 95% of all gift cards that are sold at retail.

Devices for recording, storing and playing back audio have been associated with greeting cards and the like, such as is disclosed in U.S. Pat. Nos. 5,577,018; 5,652,606 and 6,845,583. The audio circuitry typically includes a speaker that also functions as a microphone when recording a message, a control circuit, a memory circuit to provide random access memory, one or more switches, batteries to provide power to the device, and associated wiring and mounting hardware.

What is needed, therefore, is a gift card holder that may be used in association with a gift card to personalize the gift of the card to the recipient, either through selected indicia or audio of interest or entertainment to the recipient or through indicia or an audio recording provided by the gift giver, and which may fit within the space constraints already in place for gift cards mounted on carrier panels, or for gift card packets.

BRIEF DESCRIPTION OF THE INVENTION

The purpose of this invention is to provide a gift card holder that bears indicia for indicating the name of the sender and recipient of the gift card, decorations of various styles or themes, a slot for inserting a gift card into the holder, a gift card sheet including a peg hole for hanging the gift card and holder upon a display rack, and circuitry for recording and playing sound such as music and/or a message from the gift giver, including a sound speaker, a power source such as one or more commonly available watch batteries, and record and playback buttons. Typically, the holder is sold to the gift giving consumer wrapped around a gift card and attached or integral hang tag (gift card packet). The gift card may be disposed so that the magnetic strip of the gift card projects below the holder thereby enabling the card to be loaded with a stored value at the point of sale. The bi-fold design of the holder wraps around a gift card packet but occupies essentially the same space footprint as the gift card packet would on display stand, thereby enhancing value while allowing the same number of units to be displayed.

Other advantages of the invention will become apparent from the following description taken in connection with the accompanying drawings, wherein is set forth by way of illustration and example an embodiment of the present invention.

BRIEF DESCRIPTION OF THE DRAWINGS

FIG. 1 is a view of a multi-panel sheet used to assemble a gift card holder showing the surfaces of the holder that remain external after folding and assembly.

FIG. 2 is a view of the sheet of FIG. 1 primarily showing surfaces that are internal subsequent to folding and assembly.

FIG. 6 is a view of the gift card sheet positioned upon the inside center panel.

FIG. 7 is a view of the right panel folded over the gift card sheet.

FIG. 8 is a view of the front panel folded over the right panel to secure the gift card sheet within the holder for display and sale.

DETAILED DESCRIPTION

Figure 3:
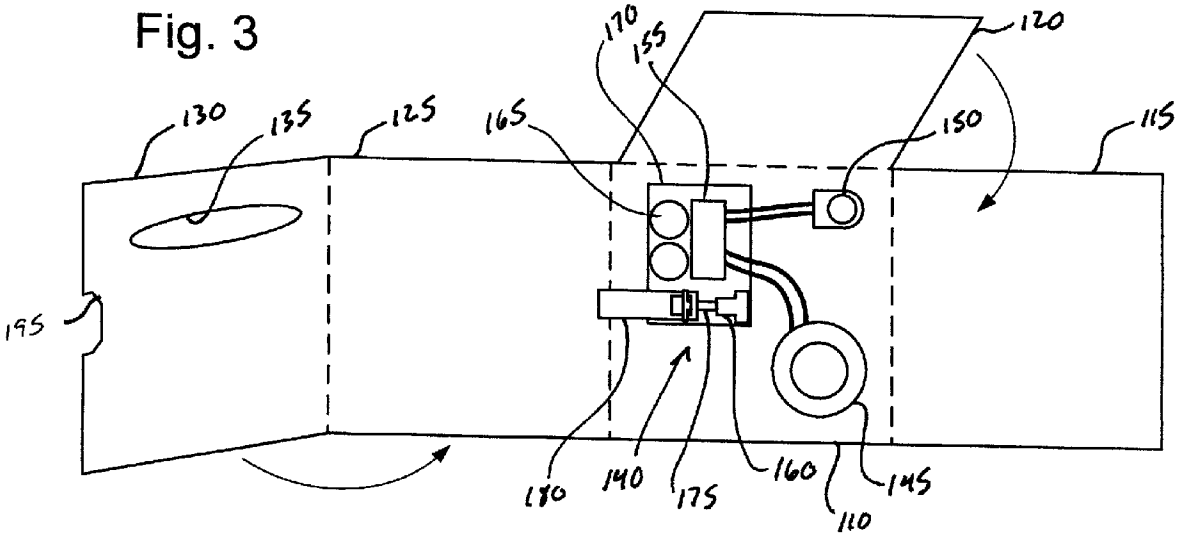
FIG. 3 is a view of the sheet of FIG. 2 showing audio components attached to the inner surface of the center panel.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1 through 12, there is shown an embodiment of a gift card holder of the present invention indicated generally by the reference numeral 100. FIG. 1 provides a view of a multi-panel sheet 105 used to assemble the gift card holder 100 showing the surfaces of the holder 100 that remain external after folding and assembly. The sheet 105 typically comprises a single piece of heavy paper or light cardboard having five distinct panels defined by fold lines and the outer margins of the sheet. FIG. 2 is a view of the sheet of FIG. 1 primarily showing surfaces that are internal subsequent to folding and assembly. With further reference to FIGS. 1 and 2, and referencing the directional orientation of the sheet 105 as shown in FIG. 2, the panels include a center panel 110, a right panel 115 projecting from the right margin of the center panel 110, an inside center panel 120 projecting from the upper margin of the center panel 110, a front panel 125 projecting from the left margin of the center panel 110, and an inside left panel 130 projecting from the left margin of the front panel 125. The center panel 110 typically includes indicia on the external surface thereof to prompt the user to indicate the identity of the gift giver and of the gift recipient, i.e. "to/from indicia". The inside left panel 130 includes an aperture or slot 135 that provides an opening to a pocket formed when the inside left panel 130 is adhered along the margins to the front panel 125, thereby enclosing the space therebetween. The inside left panel 130 may include indicia to prompt the user to indicate the cash value stored or provided by an associated gift card, i.e. "amount indicia". The inside left panel 130 may also include indicia to prompt the user to write a message to the intended gift card recipient, i.e. "message indicia". It should be appreciated that any of the panel surfaces visible to a user following assembly of the multi-panel sheet 105 to form an assembled gift card holder 100 may be printed with the above-referenced indicia.

As shown in FIG. 3, audio components 140 of the gift card holder 100 are attached to the inner surface of the center panel 110 using any desired operable means such as adhesive. The audio components 140 typically include a speaker 145 for recording and playing back sound, a record button 150, control and storage circuitry 155 including an integrated circuit and random access memory, a playback switch 160, and a power source such as one or more watch batteries 165. All or some of these audio components 140 may be mounted upon a circuit board 170 or similar structure. The circuit board 170 is generally rectangular and sized to fit within the margins of the center panel 110, allowing sufficient space around the margins to accept adhesive. The circuit board 170 is formed of materials commonly used for such purpose in the prior art, typically a thermally stable non-conductive material such as thermoset plastic or epoxy-fiberglass laminates. An example of appropriate prior art circuitry of the type that may be adapted for use with this device includes a digital recording unit sold by Radio Shack, part no. 276-1323.

When the record button 150 is pressed a user may record an audible message by speaking into the speaker 145. The record button 150 typically comprises a pressure sensitive switch. When the playback is switch 160 is engaged, the recorded message is retrieved from digital memory and played over the speaker 145. The playback switch 160 typically comprises a slide switch. An arm 175 of the playback switch 160 is attached (typically via a cardboard or plastic extension arm 180) to an inner surface of the front panel 125 proximate the right front panel margin.

Typically, one or more indicia indicating the location, and perhaps functionality, of the record button 150 are provided on either the external surface of the center panel 110 or on the external surface of the inside center panel in proximity to the record button 150 held therebetween.

Figure 4:
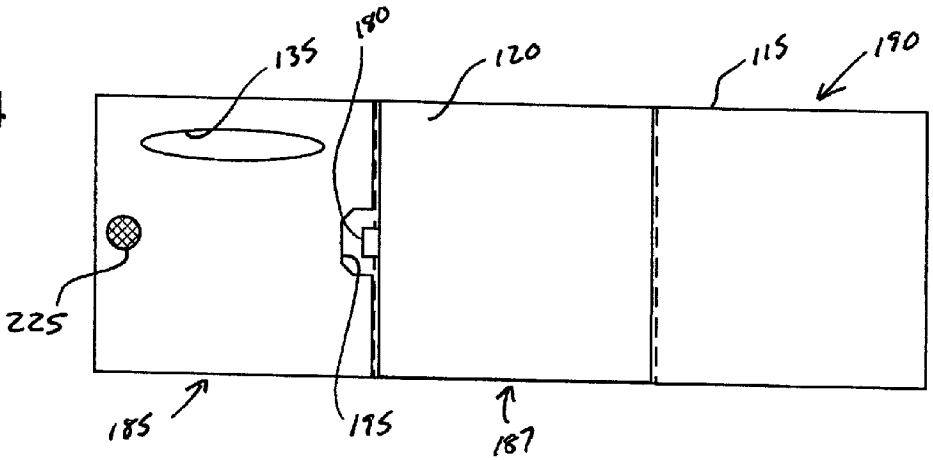
FIG. 4 is a view of the sheet of FIG. 3 showing the left panel folded inward against the front panel and the inside center panel folded inward against the center panel.

Once the audio components 140 are attached to the inside surface of the center panel 110, the inside center panel 120 is folded inward to cover and enclose the audio components 140. The inside surface of the inside center panel 120 is attached to the inside surface of the center panel 110 using adhesive disposed along the margins thereof. A left cover 185 is formed by folding the inside left panel 130 against the inside surface of the front panel 125. The inside surfaces of these two panels (130 and 125) are adhered to one another using adhesive disposed along the margins thereof. A right cover 190 simply comprises the right panel 115 in this embodiment. A notch 195 is provided in the inside left panel 130 to accommodate the extension arm 180, which moves away from the surface of the front panel 125 as the left cover 185 is closed. FIG. 4 shows the left panel 130 folded inward against the front panel 125 and the inside center panel 120 folded inward against the center panel 110 to form a center cover 187.

Figure 5:
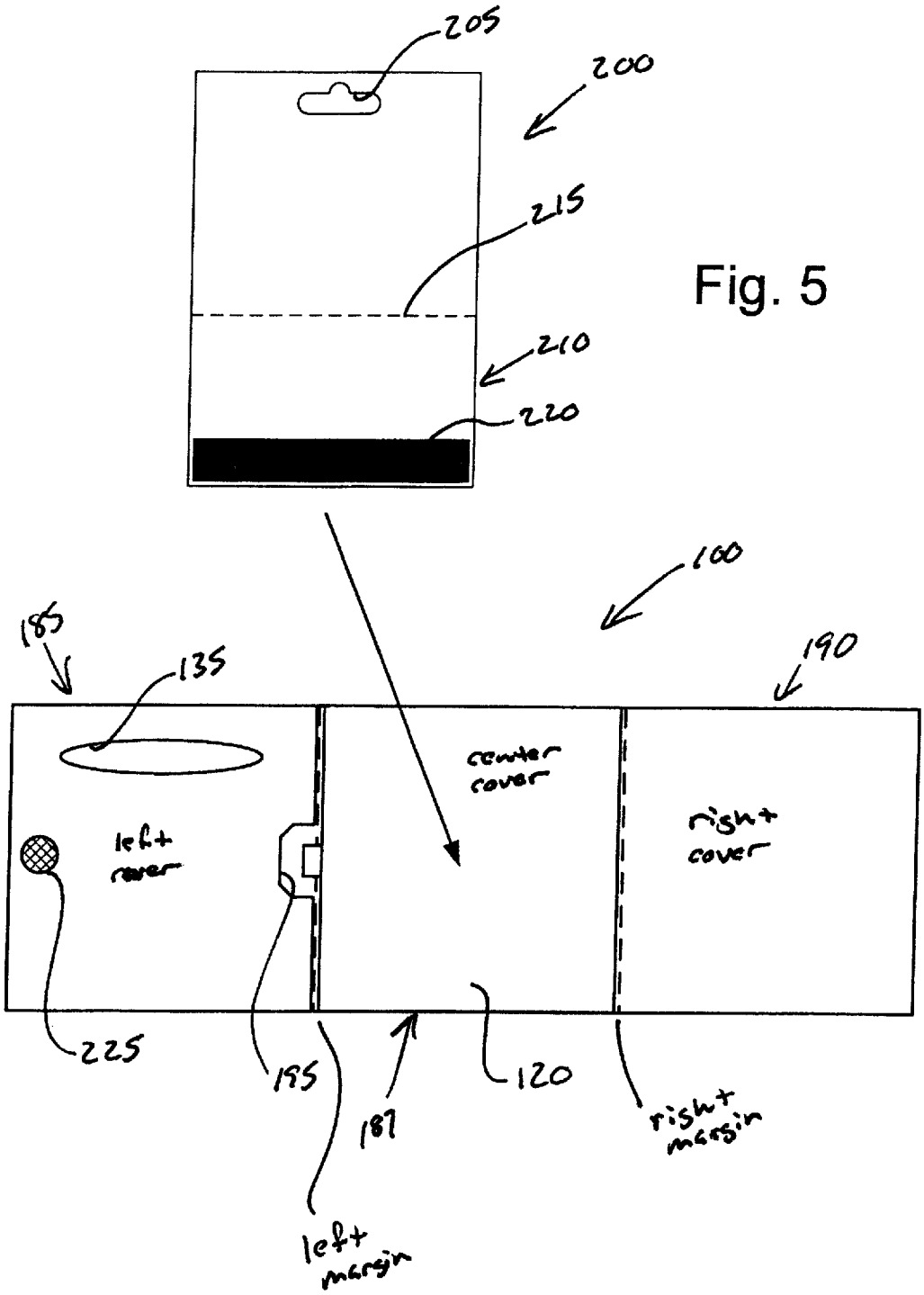
FIG. 5 is a view of the gift card sheet and holder prior to installation of the gift card sheet within the holder.
Figure 9:
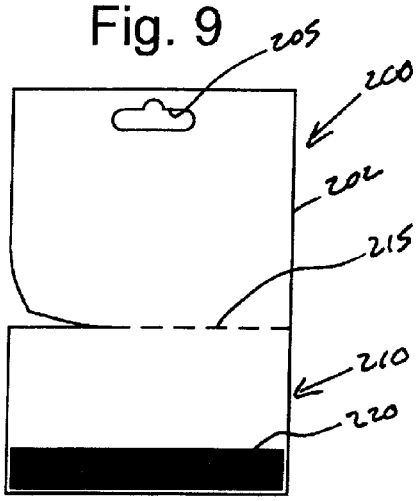
FIG. 9 is a view of an embodiment of the gift card sheet wherein the lower portion of said sheet comprises a gift card defined from the upper portion by a transverse line of perforation.
Figure 10:
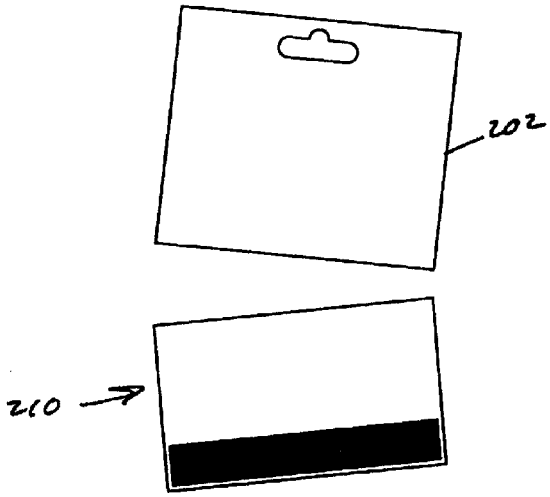
FIG. 10 is a view of the gift card separated from the upper portion of the gift card sheet.
Figure 11:
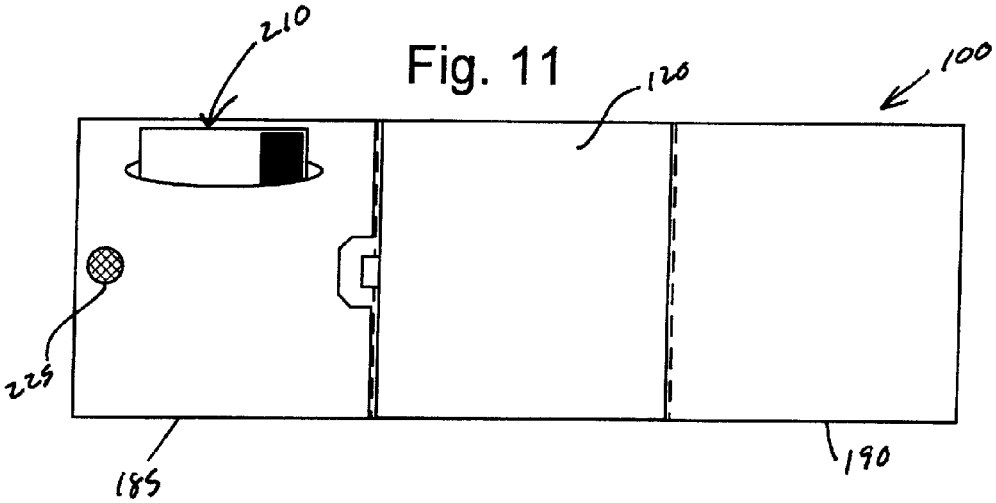
FIG. 11 is a view of the gift card installed within the left panel pocket.

FIG. 5 is a view of a gift card sheet 200 and holder 100 prior to installation of the gift card sheet 200 within the holder 100. The gift card sheet 200 includes an aperture or hole 205 for hanging the gift card sheet 200 upon a display hook (not shown). A lower portion of the gift card sheet 200 may comprise a removable gift card 210 defined from the upper, hang tag portion 202 of the gift card sheet 200 by a transverse line of perforation 215. The gift card 210 may typically include a magnetic strip 220 or other means for storing or encoding stored or credited value information. In certain embodiments, the gift card sheet 200 element comprises a gift card packet that may include a gift card removably adhered to a card board backing, or a gift card and card board backing wrapped in clear plastic or cellophane to hold the card to the backing. In such cases, the backing typically includes a peg hole for hanging the gift card packet upon a display stand hook.

Gift cards 210 are often presented for sale on display racks in stores. In the prior art, gift cards 210 are typically simply attached to a gift card carrier panel or packet and hung upon J-hooks. A gift card 210 and its carrier must fit within a set allocated space on the display rack. More specifically, a gift card carrier typically must not exceed 5.25" tall and 4" wide. These dimensions are an industry standard and are typically non-negotiable.

The gift card holder 100 of the present invention is specifically designed to enhance the value of a gift card 210 by providing a wrap around structure that provides additional space for graphics and personalized messages, as well as audio capability, while not taking any additional viewable display space on the display rack. The holder 100 still provides accessibility to the gift card 210 at the point of sale via the gift card carrier panel or sheet 200, with the entire holder 100 assembly remaining within the standardized size constraints already in effect upon gift cards 210 and carrier panels in the prior art.

As illustrated sequentially in FIGS. 6 through 8, the gift card sheet 200 is placed upon the inside center panel 120 and then the right and left covers 190 and 185 are folded over the gift card sheet 200 and secured to one another via hook and loop fasteners 225 and 230. The gift card holder 100 may now be hung upon a display rack (not shown) using the aperture 205 in the gift card sheet 200.

Since the gift card magnetic strip 220 extends below the lower margin of the holder 100, the magnetic strip 220 may be swiped through a magnetic card reading and storage device at the point of purchase without removing the gift card 210 from the holder 100.

Prior to gifting, the gift card sheet 200 is removed from the holder 100 by opening the right and left covers 190 and 185. As shown sequentially in FIGS. 9 through 11, the gift card 210 is separated from the gift card sheet 200 by tearing along the perforated line 215. The separated gift card 210 is then passed through the slot in the inside left panel 130 to install the card 210 within the pocket in the left cover 185. In alternative embodiments (not shown) the gift card may be provided as a separate unit removably adhered to the surface of the gift card sheet or held to the gift card sheet via plastic wrap, cellophane or similar material.

Figure 12:
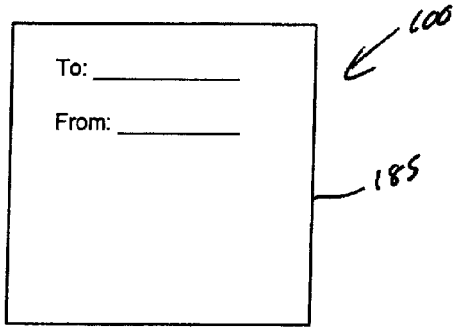
FIG. 12 is a view of the right panel folded over the center panel and the front panel folded over the right panel to place the holder in a folded disposition for gifting.

As shown in FIG. 12, the right cover 190 is then folded over the inside center panel 120 and the left cover 185 is folded over the right cover 190 to place the holder 100 in a folded disposition for gifting.

Figure 13:
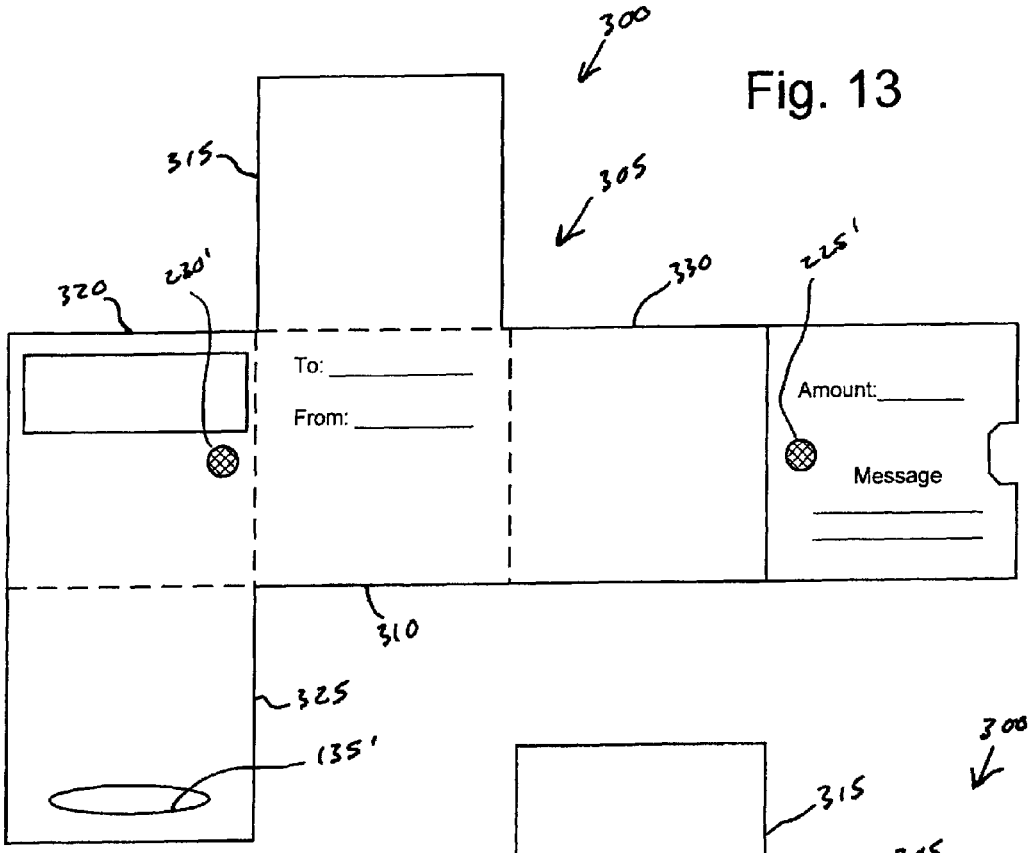
FIG. 13 is a view of a multi-panel sheet used to assemble an alternative embodiment of a gift card holder showing the surfaces of the holder that remain external after folding and assembly.
Figure 14:
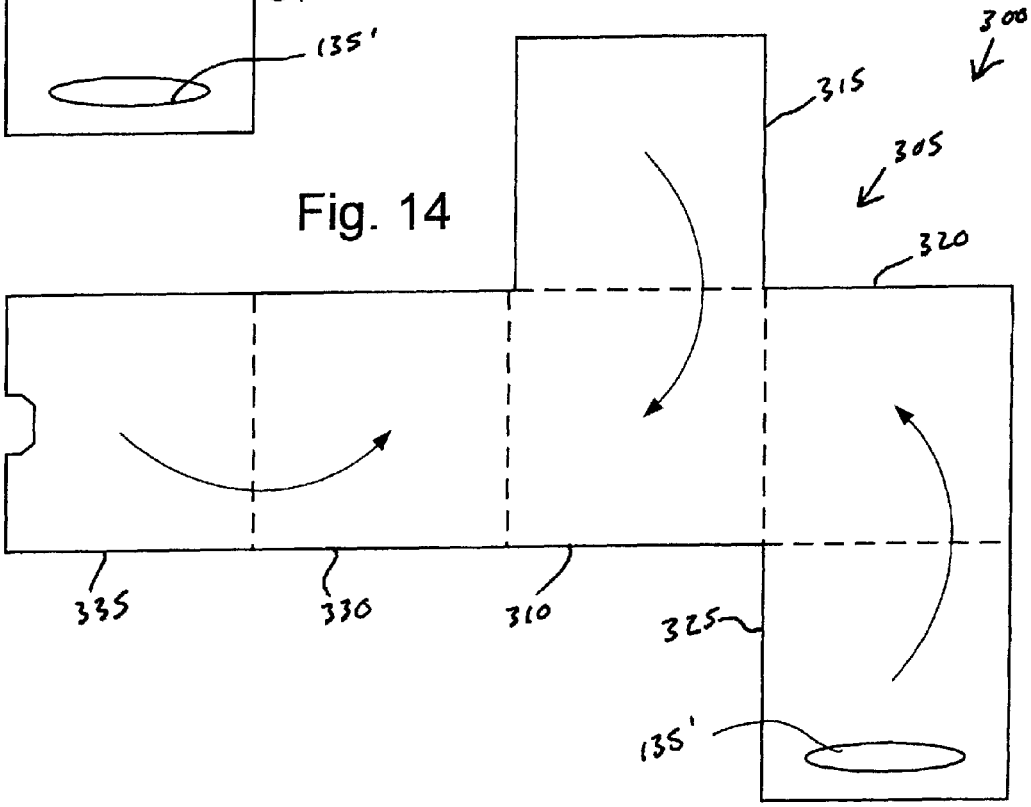
FIG. 14 is a view of the sheet of FIG. 13 showing surfaces that are internal subsequent to folding and assembly.

FIGS. 13 and 14 provide views of opposing sides of a multi-panel sheet 305 used to assemble an alternative embodiment of a gift card holder 300. FIG. 13 shows surfaces of the sheet 305 that remain external after folding and assembly. FIG. 14 shows surfaces of the sheet 305 that are internal (glued together) subsequent to folding and assembly. Referencing the directional orientation of the sheet 305 as shown in FIG. 14, the sheet 305 comprises a center panel 310, an inside center panel 315 that projects from the upper margin of the center panel 310, a right panel 320 that projects from the right margin of the center panel 310, an inside right panel 325 that projects from the lower margin of the right panel 320, a front panel 330 that projects from the left margin of the center panel 310, and an inside left panel 335 that projects from the left margin of the front panel 330. Arrows in FIG. 14 indicate that the inside left panel 335 is folded rightward over the front panel 330 to form a left cover, the inside right panel 325 is folded upward over the right panel 320 to form a right cover, and the inside center panel 315 is folded downward over the center panel 310. A first panel may be affixed to a corresponding underlying second panel (over which the first panel has been folded) by applying adhesive along the outer margins of the inner surface of the first panel and pressing such inner surface against the inner surface of the underlying second panel. A slot 135' is provided in the inside right panel 325 to provide egress to the enclosed pocket formed in the right cover when the inside right panel 325 is folded over the right panel 320. Cooperating hook and loop fasteners 225' and 230' secure the left cover to the right cover when the left cover is folded over the right cover.

Figure 15:
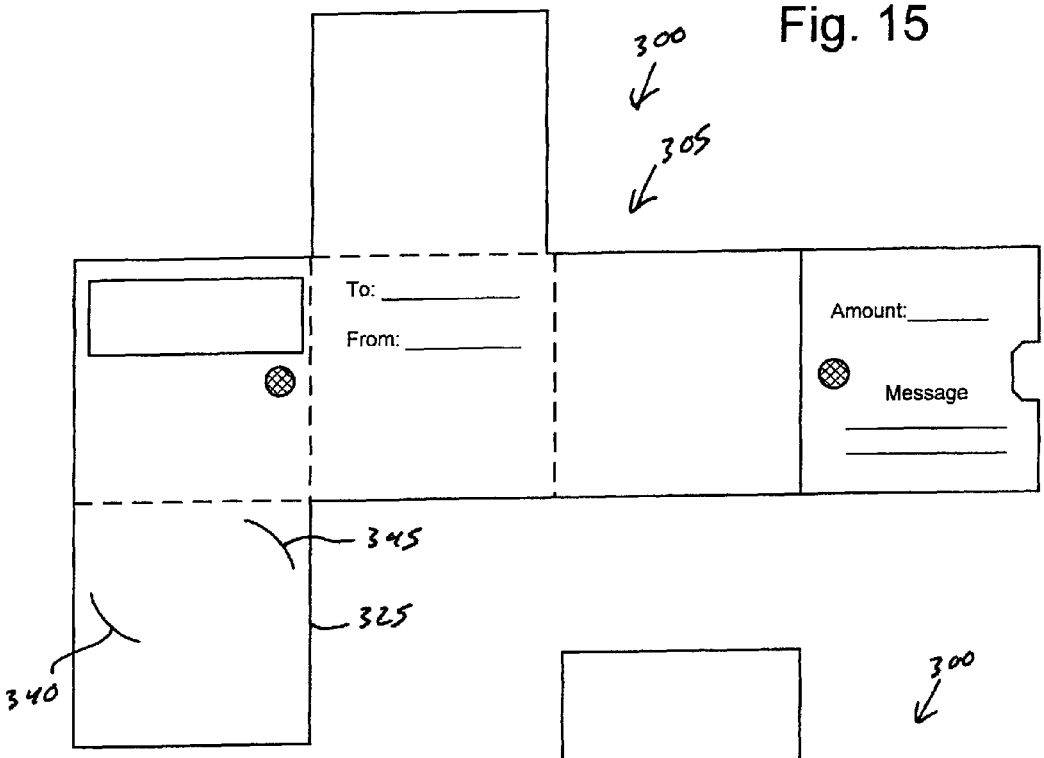
FIG. 15 is a view of a multi-panel sheet used to assemble a further alternative embodiment of a gift card holder showing the surfaces of the holder that remain external after folding and assembly.
Figure 16:
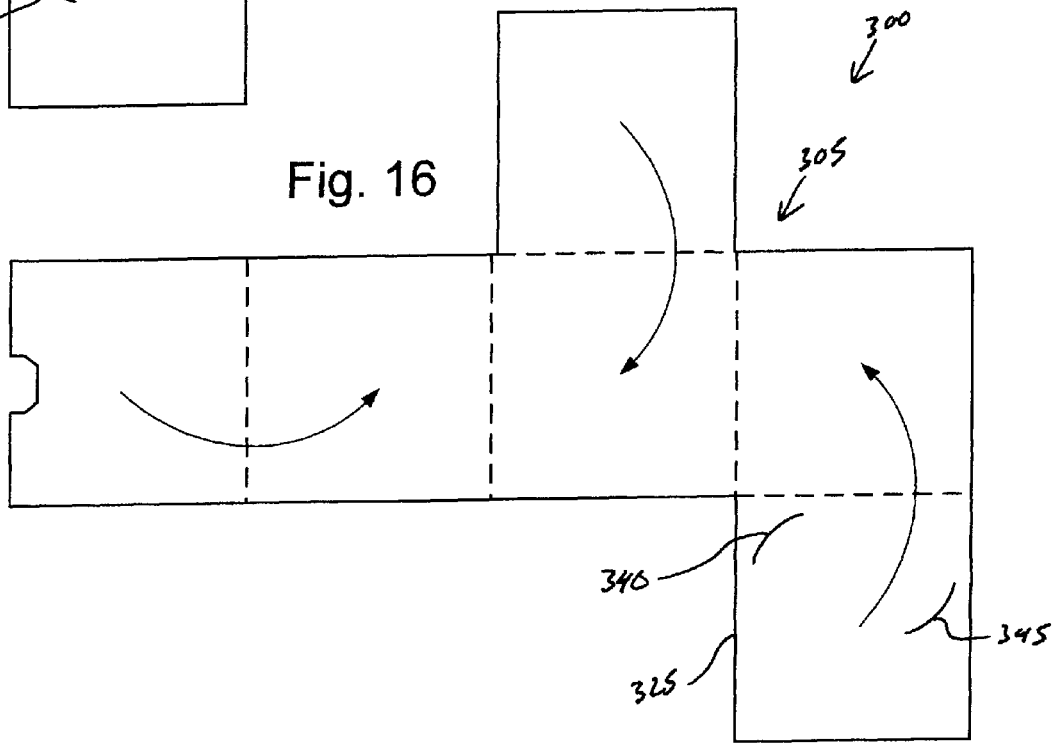
FIG. 16 is a view of the sheet of FIG. 15 showing surfaces that are internal subsequent to folding and assembly.

FIGS. 15 and 16 provide views of a multi-panel sheet 305 having slits 340 and 345 for holding a gift card in place upon the inside right panel 325 instead of a slot.

The surfaces of the holder 100 may include various surface decorations, images or text printed thereon or adhered thereto.

What is claimed is:

1. A card holder assembly comprising:

a holder including:

six or fewer distinct panels defined by fold lines and the outer margins of the holder;

a generally planar center panel hingedly engaged to a generally planar center cover, said center cover projects from an upper margin of said center panel;

a generally planar right panel projecting from a right margin of said center panel, the right panel hingedly engaged to a generally planar right cover, the right panel having a fastening means;

a generally planar left panel projecting from a left margin of said center panel, the left panel hingedly engaged to a generally planar left cover, the left cover having a fastening means;

where the center panel, the right panel, and the left panel have substantially equal dimensions; and where a gift card is received in a slot formed in at least one of the covers;

audio components disposed between the center panel and the center cover, the audio components further comprising a switch engaged to one end of arm, where an opposite end of the arm is engaged to an surface of at least one of the right panel or the left panel such that rotation of the right panel or the left panel engaged to the arm activates the switch;

wherein the center cover is rotated about the upper margin and fixedly attached to a lower margin of the center panel; and a gift card sheet including:

the gift card removably engaged to a hanger panel;

where the gift card sheet is separate from said holder, and is received against an exterior surface of said center cover;

where said right panel is rotated about the right margin of said center panel to enclose the gift card sheet within said holder and said left panel is rotated about the left margin of the center panel to contact the right panel when in a closed configuration; and where said fastening means on the left cover is secured to the fastening means on the right panel.

2. The card holder assembly of claim 1, wherein the card holder assembly has a right cover slot, a center cover slot, and a left cover slot, wherein the gift card is received in one of the right cover slot, center cover slot, or left cover slot.

3. The card holder assembly of claim 1, wherein the gift card is received in a pocket formed by at least one of the right panel, the center panel, or the left panel, and a corresponding right cover, center cover, or left cover.

4. The card holder assembly of claim 1, wherein said left panel is hingedly connected to said center panel.

5. The card holder assembly of claim 1, wherein said right panel is hingedly connected to said center panel.

6. The card holder assembly of claim 1 wherein the audio components further comprise a record button, memory, and a power source.

7. The card holder assembly of claim 1 wherein a magnetic strip of said gift card projects below a lower margin of said gift card holder, when the gift card sheet is enclosed within the holder to enable swiping said magnetic strip through a magnetic card reading device without removing said gift card sheet from said holder.

8. The card holder assembly of claim 1, wherein a bi-fold design of the holder wraps around a gift card packet to occupy the same space as said gift card packet on a display stand in the closed configuration.

9. The card holder assembly of claim 1, wherein said gift card sheet removably attaches directly to a display stand.

10. The card holder assembly of claim 1, wherein said gift card is separable from said hanger panel via perforations.

11. The card holder assembly of claim 1, wherein the left cover rotates about a fold line between the left cover and the left panel and the left cover is adhered to the left panel about an outer margin of the left panel.

12. The card holder assembly of claim 1, wherein the center cover rotates about a fold line between the center cover and the center panel and the center cover is adhered to the center panel about an outer margin of the center panel.

13. The card holder assembly of claim 1, wherein the right cover rotates about a fold line between the right cover and the right panel and the right cover is adhered to the right panel about an outer margin of the right panel.

14. A card holder assembly comprising:

a bi-fold holder assembled from a planar material, the planar material comprising:

six or fewer distinct panels defined by fold lines and the outer margins of the holder;

a generally planar center panel hingedly engaged to a generally planar center cover where the center cover rotates about a fold line between the center cover and the center panel and the center cover is adhered to the center cover about an outer margin of the center panel to form a center bi-fold portion;

a generally planar right panel projecting from a right margin of the center panel, the right panel hingedly engaged to a generally planar right cover, where the right cover rotates about a fold line between the right cover and the right panel and the right cover is adhered to the right cover about an outer margin of the right panel to form a right bi-fold portion, where the right panel has a fastening means;

a generally planar left panel projecting from a left margin of the center panel, the left panel hingedly engaged to a generally planar left cover, where the left cover rotates about a fold line between the left cover and the left panel and the left cover is adhered to the left cover about an outer margin of the left panel to form left bi-fold portion, where the left cover has a fastening means;

where the center bi-fold portion, the right bi-fold portion, and the left bi-fold portion have equal maximum widths and equal maximum heights; and wherein at least one of the center bi-fold portion, the right bi-fold portion, and the left bi-fold portion defines a pocket to receive a gift card therein;

audio components disposed between the center panel and the center cover, the audio components further comprising a switch engaged to one end of arm, where an opposite end of the arm is engaged to an surface of at least one of the right panel or the left panel such that rotation of the right panel or the left panel engaged to the arm activates the switch; and a removable gift card carrier panel including a gift card is removably engaged to a hanger panel, where the gift card carrier panel is received against an exterior surface of the center bi-fold portion and where said right bi-fold portion is rotated about the right margin of the center panel to enclose the gift card sheet within the holder and the left panel is rotated about the left margin of the center panel to contact the right panel when the bi-fold holder is in a closed configuration and where the fastening means on the left cover is secured to the fastening means on the right panel.

* * * * *